United States Patent [19]

Bitsky et al.

[11] 4,368,052

[45] Jan. 11, 1983

[54] METHOD AND APPARATUS FOR LINING BULK BOX BLANKS

[75] Inventors: Thomas C. Bitsky, Oak Lawn; Joseph R. Wilkus, Tinley Park, both of Ill.

[73] Assignee: Peerless Metal Industries, Inc., Bridgeview, Ill.

[21] Appl. No.: 178,751

[22] Filed: Aug. 18, 1980

[51] Int. Cl.[3] ..... B31B 7/00

[52] U.S. Cl. ..... 493/96; 493/130; 493/141; 493/295; 493/7

[58] Field of Search ..... 493/97, 96, 110, 6, 493/7, 130, 128, 141, 182, 181, 180, 125, 295; 156/578; 118/323

[56] References Cited

U.S. PATENT DOCUMENTS

| | | | |
|---|---|---|---|
| 2,057,264 | 10/1936 | Pierce | 118/323 X |
| 2,502,117 | 3/1950 | Anderson | 493/110 X |
| 3,072,095 | 1/1963 | Keessen et al. | 118/323 X |
| 3,353,459 | 11/1967 | Owsley | 493/96 |
| 3,388,640 | 6/1968 | Giannella | 493/128 X |
| 3,459,105 | 8/1969 | Waldbauer | 493/130 X |
| 3,611,884 | 10/1971 | Hottendorf | 493/479 X |
| 3,964,953 | 6/1976 | Mitchard et al. | 156/300 |

*Primary Examiner*—James F. Coan

*Attorney, Agent, or Firm*—Mason, Kolehmainen, Rathburn & Wyss

[57] ABSTRACT

A method and apparatus for lining bulk box blanks starting with flat, seamed blanks and resulting in flat, lined, tubular blanks. Glue is applied across the length of the seamed blanks excluding the seam regions. After a liner is placed on the adhesive bearing surface of the blank the blank and liner are moved together to a compression station in a direction transverse to the direction of glue application. The liner and blank are pressed together in the compression station and then forwarded to a folding station where the blank quarter sections defined by preformed seams and slits are folded together atop the remaining, intermediate half section to form a flattened tubular blank. While the blank is enroute to the folding station, glue is applied to a flap along the edge of one quarter section to secure the two unattached edges of the blank together to form the tubular blank. The tubular blank is then forwarded to a second compression station secured in its folded configuration by an overhead sled that rotates atop the tubular blank after the folding is completed. At subsequent processing stations the blank is opened and folded to form a box to be filled.

30 Claims, 13 Drawing Figures

D
A
B
C
F
F
38
55
60
56
54
55
52
52
50
68
42
58
74
62
66
70
68
70
64
72
142
108
136
116
112
114
110
108
112
114
122
124
152
120
110
131
143
133
144
138
132

FIG. 9a
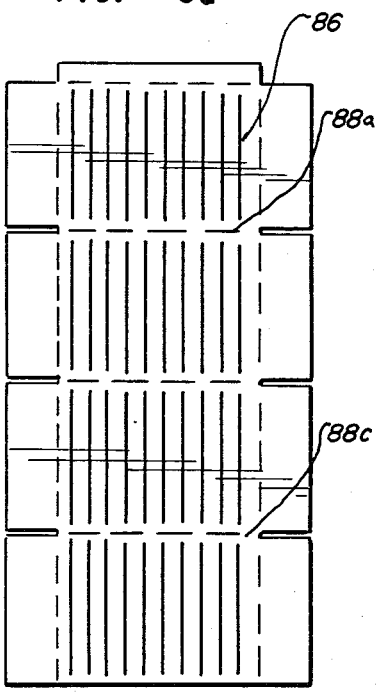
FIG. 9b
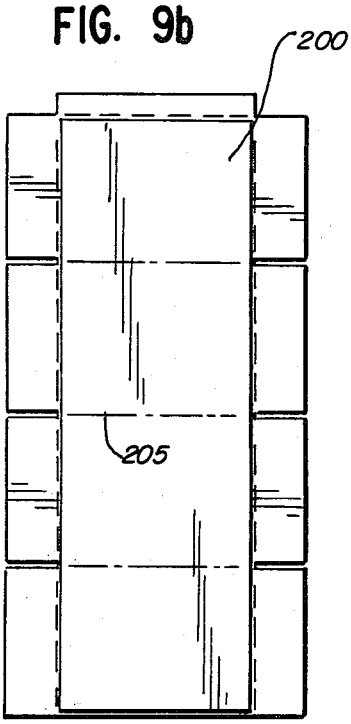
FIG. 9c
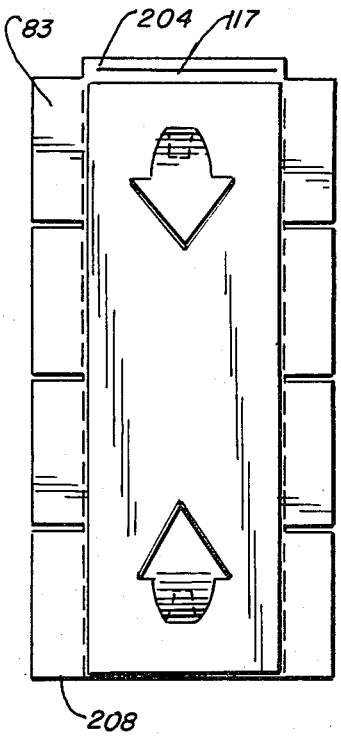
FIG. 9e
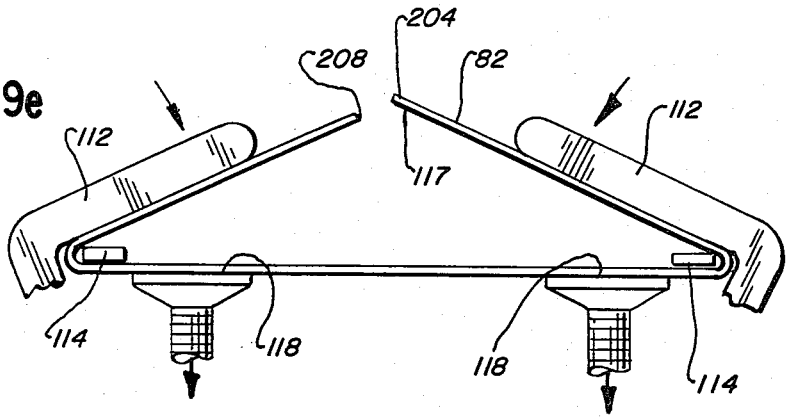
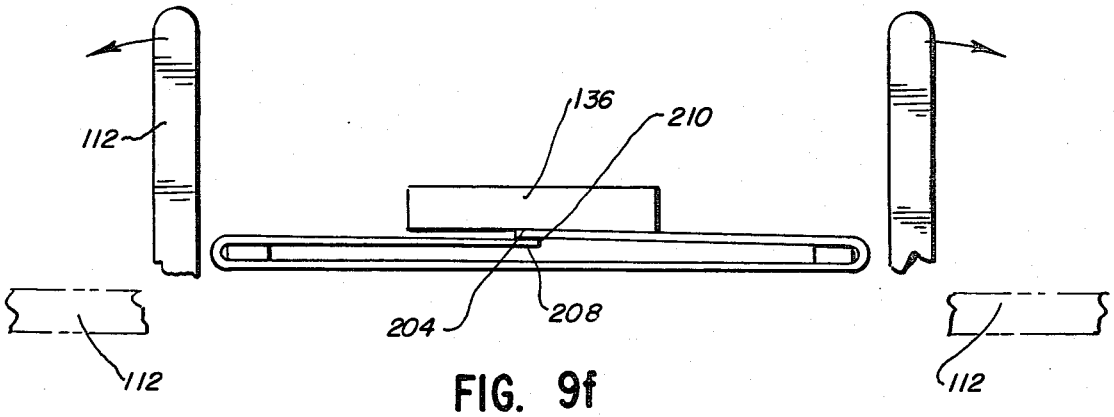
FIG. 9f

METHOD AND APPARATUS FOR LINING BULK BOX BLANKS

BACKGROUND OF THE INVENTION

1. Field of the Invention

This invention relates generally to methods and apparatus for lining cardboard box blanks and particularly to methods and apparatus for lining bulk box blanks.

2. Background of the Invention

Several continuous and intermittent processes for incorporating support liners into cardboard box blanks are known in the art. For example, U.S. Pat. Nos. 2,432,053 issued to Waters on Dec. 2, 1947, 2,502,117 issued to Anderson on Mar. 28, 1950 and 3,772,121 issued to Peltier on Nov. 13, 1973 describe various methods for inserting liners into formed or unformed conventional box blanks.

However, the prior art conventional box lining approaches are not suitable for forming lined "bulk" box blanks. Bulk box blanks are very large box blanks designed for heavy duty applications. In the petro-chemical industry, for example, bulk boxes contain large quantities of heavy bulk chemicals. Bulk box blanks are conventionally of a size on the order of about 400 centimeters by about 125 centimeters and have a thickness of from 1 to 2 centimeters. These boxes must be lined with comparable liners to withstand the severe loads placed on them. Generally the blanks are extremely rigid and are therefore not amenable to easy processing. These extraordinary characteristics have hampered the development, in the prior art, of an automated continuous or intermittent process suitable for efficient commercial production of lined, tubular bulk box blanks.

SUMMARY OF THE INVENTION

It is an object of the present invention to provide a method and apparatus for lining bulk box blanks suitable for mechanized commercial production.

It is another object of the present invention to provide a method or apparatus which is rapid and economical.

It is still another object of the present invention to provide such a method or apparatus that produces a superior box by avoiding the application of adhesive to the blank seam areas.

It is also an object of the present invention to provide a method and apparatus for forming lined blanks in-line.

It is still another object of the present invention to provide a modular apparatus for forming lined bulk box blanks.

It is also an object of the present invention to provide an in-line apparatus that forwards blank boxes to be operated upon from station to station generally in one direction with glue application in a transverse direction.

These and other objects of the present invention are achieved by an apparatus for lining bulk box blanks having a glue application station including a surface for supporting the blanks. Means are provided for conveying the blanks away from the glue application station after gluing. The glue application station also includes a plurality of side by side glue applicators together with means for automatically applying a plurality of discrete glue strips across the blank together with control means for preventing application of glue to the blank seams. Means for moving the glue applicator across the blank transverse to the direction of forwarding of the blank are also provided. Finally means for securing the liner to the blank and for folding the blank to form an open-ended tube are included.

BRIEF DESCRIPTION OF THE DRAWING

These and other objects and advantages of the present invention will become more apparent by reference to the following description taken in conjunction with the accompanying drawing wherein:

FIGS. 9*a–c* are plan views of a blank illustrating the formation of the folded tubular box blank in accordance with the teachings of the present invention; and FIGS. 9*d–e* are cross-sectional views taken generally along the line 6—6 of FIG. 1, showing the method of folding the blanks in accordance with the teachings of the present invention.

DESCRIPTION OF THE PREFERRED EMBODIMENT

Figure 1:
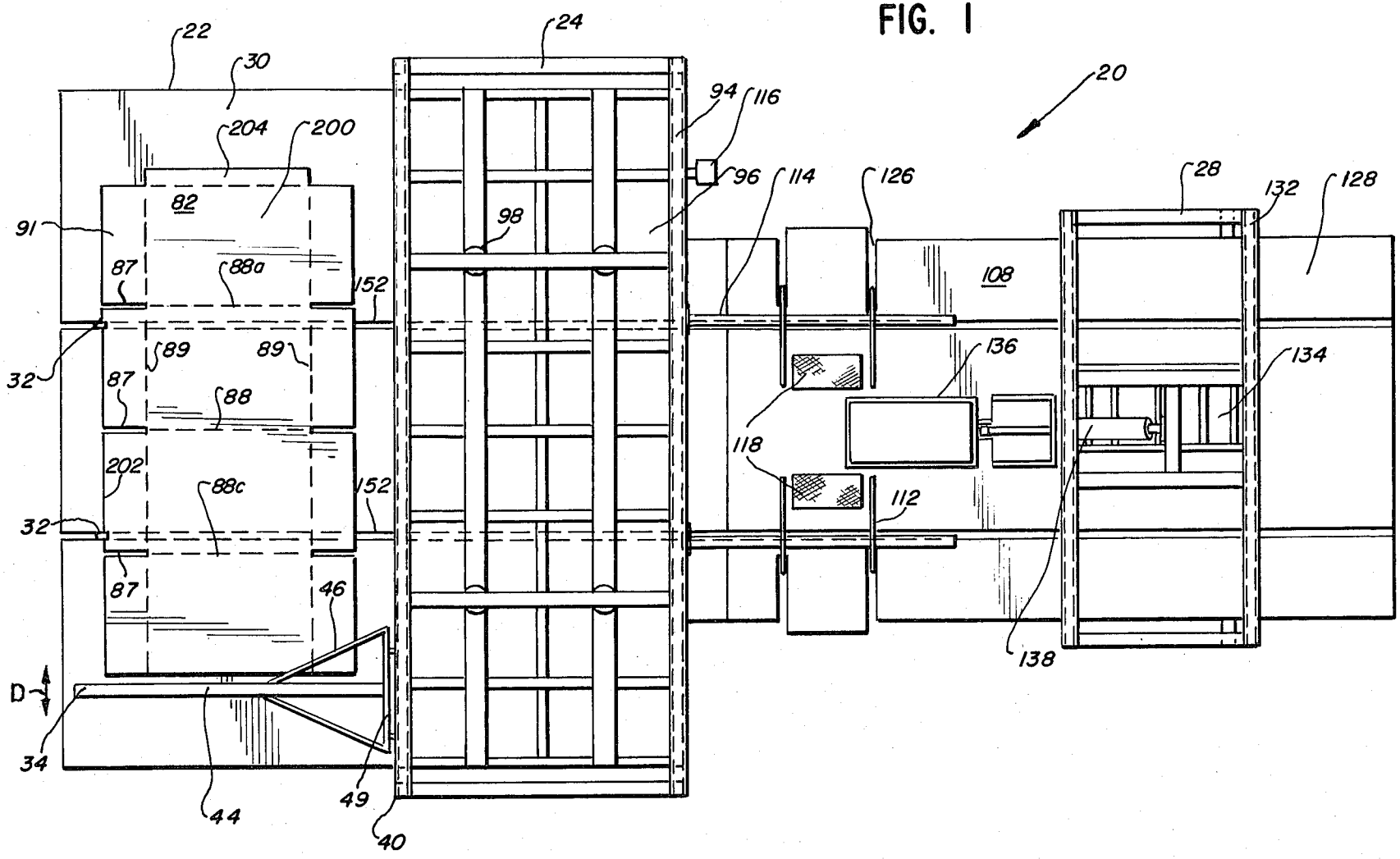
FIG. 1 is a plan view of one embodiment of the present invention.

Referring to the drawing wherein like reference characters are used for like parts throughout, there is illustrated in FIG. 1 a bulk box liner 20 including a glue application station 22, a compression station 24, a folding station 26, and a final compression station 28. Each station 22 through 28 is completely separable from each of the other stations permitting separate station shipment and, more importantly, insertion of additional component stations to increase the speed of overall system operation.

Figure 2:
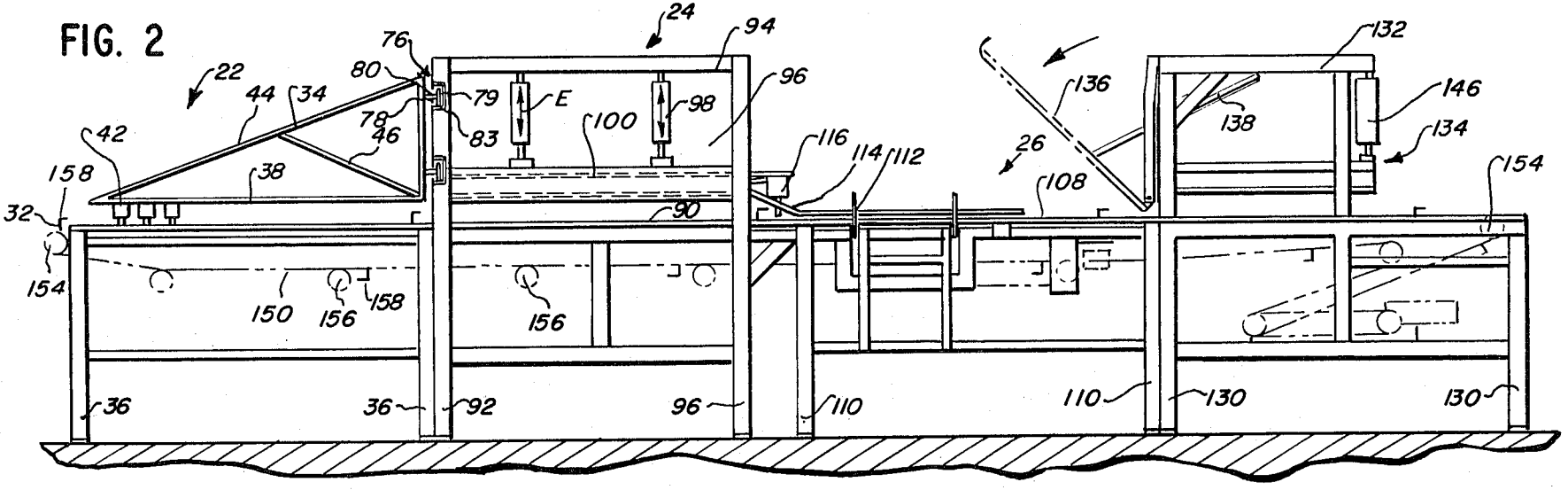
FIG. 2 is a side elevational view of the embodiment of the present invention shown in FIG. 1.

Glue application station 22 includes a supporting surface 30, a pair of spaced, parallel conveyors 32, a glue applicator 34 and a plurality of vertical support members 36 as shown in FIGS. 1 and 2. The supporting surface 30 is preferably topped with metal sheeting to promote easy sliding of box blanks on the surface and to permit easy removal of any deposited adhesive.

Glue applicator 34 includes an outwardly extending cantilevered beam 38 and a transverse support framework 40 bridging the support surface 30. The cantilevered beam 38 supports a plurality of side by side glue guns 42 extending downwardly from beam 38. The cantilevered beam 38 is supported by an upper beam 44 and a pair of angled beams 46 connected to a pair of vertical beams 48. The vertical beams 48, connected by horizontal beam 49, are mounted for relative movement with respect to support framework 40.

Figures 6, 7, 8:
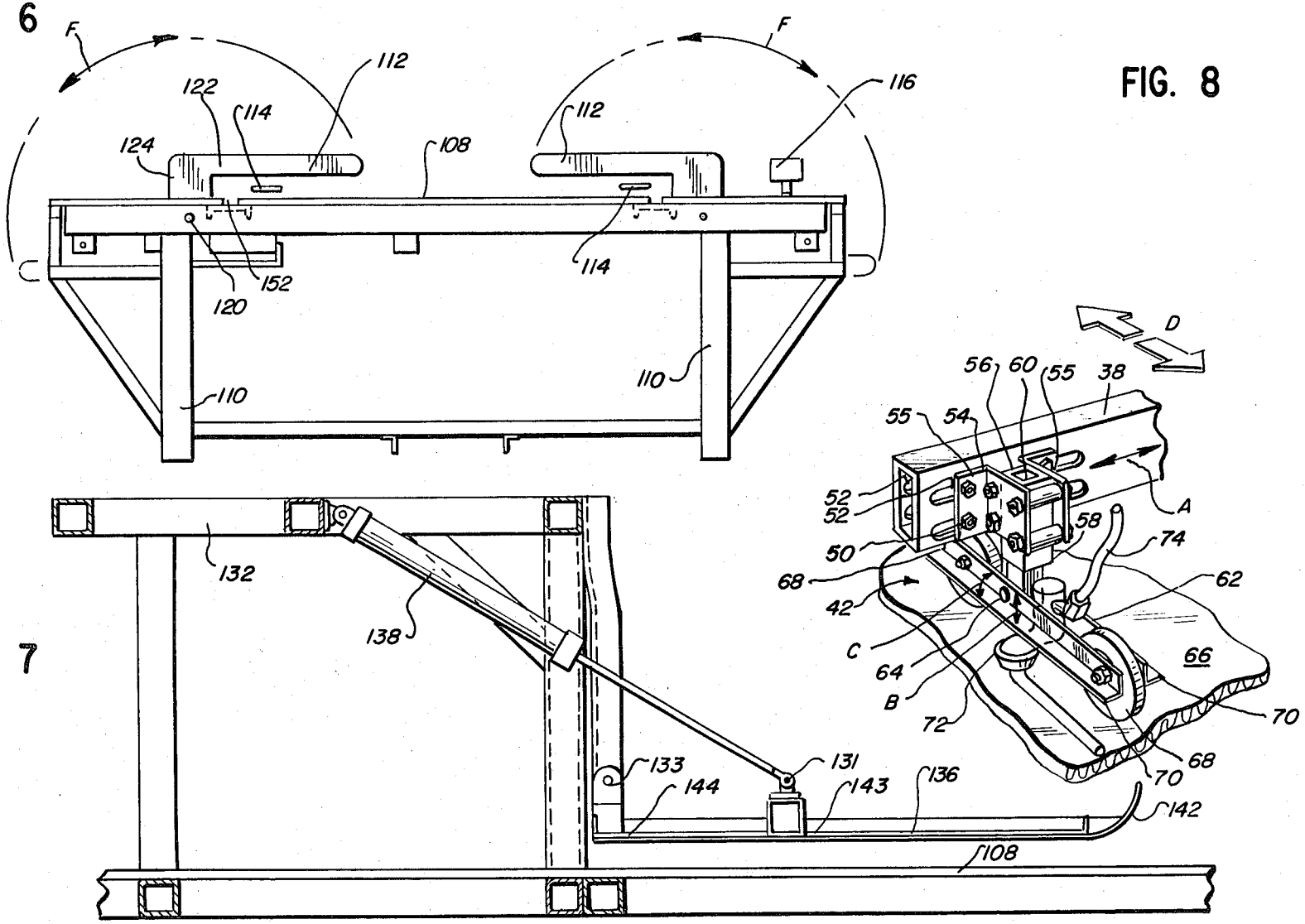
FIG. 6 is an enlarged, cross-sectional view taken generally along the line 6—6 in FIG. 1.
FIG. 7 is an enlarged, cross-sectional view taken generally along the line 7—7 in FIG. 1.
FIG. 8 is an enlarged, partial, cut-away view of the glue applicator of the embodiment shown in FIG. 1.

As illustrated in FIG. 8, each glue gun 42 is mounted by an upper and lower set of bolts 50 passing through a pair of opposed slots 52 on either side of beam 38 to permit adjustment of the position of each glue gun 42 along the length of the beam in the direction of arrows A. The bolts 50 connect to a flanged mounting bracket 54 made up of two L-shaped pieces 55 that retain between them a vertically aligned rectangular tube 56. A smaller rectangular tube 58 telescopes within the interior 60 of tube 56 and is attached directly to a wheeled glue applicating assembly 62 through a pivoting connection 64. The telescoping action of rectangular tube 58 within rectangular tube 56 allows the glue applicating assembly 62 to ride up and down on any surface 66 over which the assembly travels as indicated by the arrows B in FIG. 8. In addition, the pivoting connection 64 permits the assembly 62 to rotate around the axis of the connection 64 as indicated by the arrows C. The assembly 62 includes a pair of spaced wheels 68 attached for rotation between a pair of opposed brackets 70. The pivoting connection 64 extends freely through opposed brackets 70 and rectangular tube 58 to permit rotation of the assembly 62 with respect to beam 38. Also secured between opposed wheels 68 and brackets 70 is a glue applicating nozzle 72. The nozzle 72 is supplied by a glue tube 74 fed by a glue manifold (not shown).

The entire cantilevered beam 38 is mounted for movement in the direction of arrows D shown in FIG. 1 and FIG. 8 by a translating support mechanism 76 connecting the vertical beams 48 and the support framework 40. As shown in FIG. 2 the mechanism 76 is conveniently implemented in a conventional fashion utilizing a pair of outwardly extending pins 78 connected to each vertical beam 48, having rotatable pinion gears 79 on their ends retained within slots 80 in a cross-beams 81 and riding on rack gears 83 extending along the length of framework 40. The pinion gears may also be engaged by a reversable belt drive arrangement (not shown) to translate the beam 38 back and forth across surface 30.

A blank 82 is positioned appropriately on glue application station 22 as shown in FIG. 1. The blank includes a plurality of inwardly directed slots 87, colinear prefolded lateral seams 88 in between each pair of opposed slots 87, and a pair of longitudinal seams 89. Slots 87 and seams 89 together define the box top and bottom closure flaps 91. Seams 88 and 89 provide preformed, preferential fold lines. Preferably the blank 82 is positioned on the support surface 30 by one or more operators standing along edge 84. With the blank 82 in place the beam 38 travels across the station 22 over the blank 82 in the direction indicated by arrows D to apply glue in spaced parallel segments 86 as shown in FIG. 9*a*. The transverse path of travel of beam 38 enables operators to be positioned at the end of the device where they will have easy access to any point on the surface 30. The flow of glue is pneumatically controlled, as explained later, to prevent application of glue to the seams 88 of the blank 82.

Compression station 24 includes a horizontal support surface 90, coplanar with surface 30, a plurality of vertical support elements 92, an overhead framework 94 including the framework 40 upon which cantilevered beam 38 is supported, and a reciprocating compressor 96. The reciprocating compressor 96 includes a plurality of pneumatically operated compression cylinders 98 connected on one end to the overhead framework 94 and connected on the other end to a horizontal compression block 100. The horizontal compression block 100 is reciprocated in the direction of arrows E on command.

Figure 3:
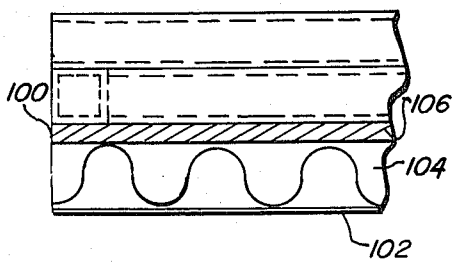
FIG. 3 is an enlarged, partial, cross-sectional view taken generally along the line 3—3 in FIG. 2.

The horizontal compression block 100 extends completely across the compression station 24 and has a compression surface area greater than the area of the blank 82. As shown in FIG. 3, the block 100 consists of a plurality of layers including an outside layer 102, a resilient intermediate layer 104 and a rigid upper layer 106 connected in turn to compression cylinders 98. The outside layer 102 is preferably made of an adhesive resistant material such as silicone cloth adhered to the layer 104. The resilient intermediate layer 104 is preferably resilient neoprene while the rigid upper layer 106 is any rigid material including plywood or the like.

The folding station 26 includes a supporting surface 108 coplanar with surfaces 30 and 90 connected to a plurality of vertical support members 110 and two pairs of opposed folding arms 112 powered by suitable operating mechanism such as a motor or hydraulic system (not shown). In addition, a pair of fixed opposed folding swords 114 and a glue gun 116 extend, in the direction of blank movement,. over the supporting surface 108 from overhead framework 94 of compression station 24. Centrally on support surface 108 between conveyors 32 a pair of vacuum outlets 118 communicating with a vacuum source are positioned in alignment with folding arms 112.

As shown in FIG. 6, folding arms 112 are generally L-shaped with one end of each arm 112 attached for rotation in the direction of the arrows F around the axis of a bar 120. Thus each arm 112 extends from a position below the surface 108 to a position extending out of and parallel to the surface 108. The arms 112 have a horizontal portion 122 parallel to but spaced above or below the surface 108 depending on the raised or lowered position of arms 112 and a vertical portion 124 that spaces the arms above or below the surface 108 in the two respective positions. In the raised position shown in FIG. 6 the arms 112 bridge the folding swords 114. Slots 126 are formed in surface 108 extending inwardly from each edge to permit the arms 112 to move between their raised and lowered positions.

Final compression station 28 includes a supporting surface 128, coplanar with surfaces 30, 90 and 108, a plurality of supporting members 130, a partial overhead frame 132, a compression mechanism 134 and a rotatable guide sled 136. The rotatable guide sled 136 and the compression mechanism 134 are mounted for independent movement on overhead frame 132. The compression mechanism 134 is identical except for its smaller scale to the reciprocating compressor 96 of station 24. As shown in FIG. 7, the L-shaped rotatable guide sled 136 includes a hydraulic cylinder 138 pivotally connected on one end to frame 132 and pivotally connected at 131 to the central portion 143 of a guide sled 136. To the sides of central portion 143 are an upwardly curved end 142 and an L-shaped end 144 attached to overhead frame 132 by a pivotal connection 133 as shown in FIG. 7. Operation of cylinder 138 causes the sled 136 to rotate from its upward position shown in dotted lines in FIG. 2 to its downward position shown in FIG. 7, extending generally parallel to surface 108 but spaced slightly above it.

The compression mechanism 134 includes pneumatic cylinders 146 and a platen 148. The platen 148 is identical in construction to block 100 except that the platen 148 has a considerably smaller dimension transverse to the direction of blank forwarding. The platen 148 like the block 100 reciprocates vertically in response to control signals applied to cylinders 146.

Figure 4:
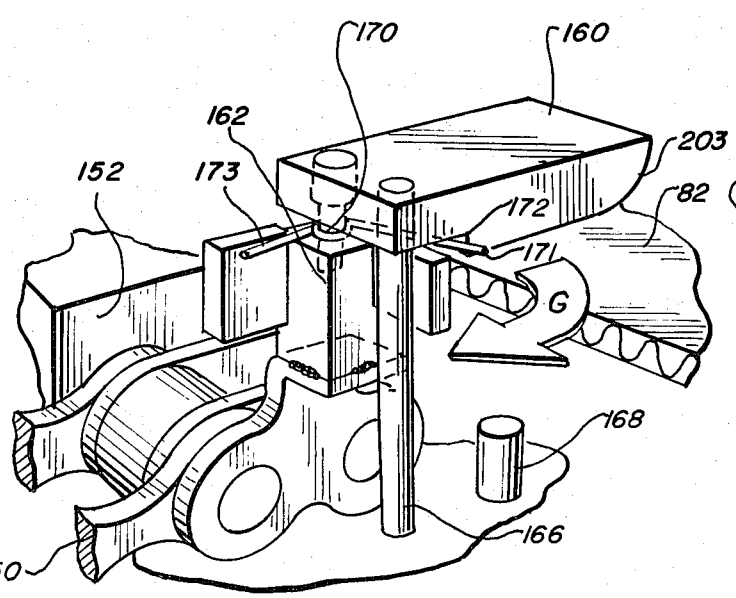
FIG. 4 is an enlarged, partial, cut-away view of the conveyer gripper of the present invention.

The spaced conveyors 32 are shown in FIGS. 1, 2 and 4. Each conveyor 32 includes an endless chain 150 riding in a recess 152 in the support surface of each station 22–28 extending along the entire length of the liner 20. Each chain 150 also extends around a roller 154 at either end of the liner 20 and under the liner supporting surfaces forming a continuous loop. Suitable guide rollers 156 also guide the chain 150 on its return path beneath the surfaces of the liner 20.

A plurality of L-shaped grippers 158 are spaced uniformly along the length of the chain 150 rising above the supporting surfaces of the liner 20 to securely engage the trailing edge 202 of each blank 82. As shown in FIG. 4, each gripper 158 includes a horizontal portion 160 situated generally parallel to the surface of the liner 20, an upstanding post 162 connected to chain 150, a rotatable pin 164 securing the horizontal portion 160 rotatably to post 162, and a downwardly extending pin 166 attached to horizontal portion 160. The horizontal portion 160 is rotated in the direction of the arrow G in FIG. 4 in response to actuation of pin 166 by an upwardly extending cam 168 fixed within recess 152. More specifically, as the gripper 158 approaches the end of the device 20 it is necessary to release the finished blank 82. This is accomplished by rotating the horizontal portion 160 that secures the blank between itself and the liner 20 about ninety degrees in a horizontal plane. This rotation of the portion 160 is caused by actuation of the pin 166 by a cam 168 as the chain 150 is forwarded, stopping pin 166 while portion 160 rotates as indicated, until pin 166 slips sufficiently around cam 168 towards chain 150 to bypass cam 168. By this time the blank 82 has been released and pin 166 passes between cam 168 and chain 150. Once the pin 166 is past the cam 168, a spring 170, conveniently a coiled spring having one end 171 secured in a groove 172 of horizontal portion 160 and the other end 173 retained by post 162, causes the horizontal portion to spring back to its original position counter to the direction indicated by the arrow G.

The method for utilizing the device 20 is as follows. A blank 82 is positioned on the glue application station 22 flat on supporting surface 30. Although in FIG. 1 the blank is shown with its length generally transverse to the length of the liner 20 the liner may be readily adapted to accept blanks 82 rotated 90° from the orientation pictured in FIG. 1. Preferably the blank 82 to be lined is positioned by an operator standing along edge 84 capable of reaching substantially over the entire surface area of station 22 if necessary to precisely position the blank 82 and to secure the trailing edge 202 of the blank in conveyor grippers 158. With the blank in position the glue applicator 34 is operated to apply glue to the outward facing surface of the blank 82 in the pattern shown in FIG. 9*a*. Specifically, cantilevered beam 38 is moved along support framework 40 generally parallel to the length of the blank 82 in the embodiment pictured in FIG. 1. As the beam 38 extends over the blank 82 a plurality of appropriately placed glue nozzles 72 apply strips of glue 86 to the blank 82.

The location of the glue strips 86 is controlled by the position of glue guns along the beam 38. That is, each gun 42 is adjusted along the length of the beam 38 by sliding the bracket 54 to the desired position and tightening bolts 50 to secure it in position. Conveniently a plurality of parallel glue strips approximately two to three centimeters apart are applied over the entire length of the blank 82 between longitudinal seams 89 that define the top and bottom of the finished box. Thus, the glue guns 42 are appropriately positioned on beam 38 aligned between fold seams 89 for the particular size blank 82 to be lined.

Figure 5:
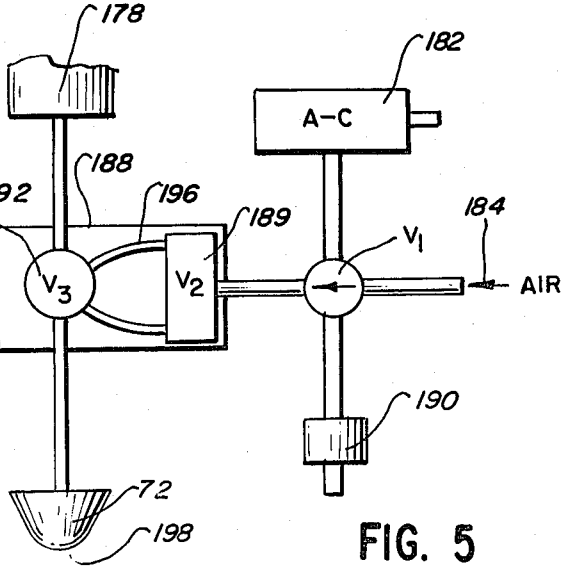
FIG. 5 is a schematic view of the glue application system of the present invention.

As shown in FIG. 5, each nozzle 72 is supplied with adhesive from a glue manifold 178 by a control system 180 which includes an automatic controller 182 and a source of pressurized air 184. Any suitable adhesive may be used, however, cold extrusion adhesive is preferred. The automatic controller 182 may be any conventional timing control device such as, for example, a microcomputer, with preprogrammed instructions corresponding to various conventional blank characteristics to form glue segments 86 between seams 88, excluding the region of the seams 88 themselves and adjacent areas from the glue application. This is important to prevent checking of the seams when the blank 82 is folded into a box. Checking, or seam cracking rendering the container worthless, is caused by stiffness imparted by dried glue at the same area when the box is folded around the seam.

To prevent glue application to the seam area the automatic controller 182 controls a valve 186, preferably an electronically controlled solenoid valve, to shunt the air supply either to a control valve 188 or to an exit port 190. The automatic controller 182 conveniently issues control signals based on the time since initial actuation of the beam 38, so that as the beam is driven toward a seam the glue flow is stopped. The flow is resumed after the beam 38 has moved past the seam 88. Thus, to apply glue the automatic controller 182 shunts the air supply to control valve 188 and to stop the flow of glue in order to avoid a seam, the controller shunts the air supply through exit port 190. The flow of air to control valve 188 causes a two exit port valve 189 to change the state of a third valve 192. Thus, each time the flow of air through the valve 188 is changed the valve 189 sends a different signal via either tube 194 or 196 to control the state of the valve 192. The flow of glue from the manifold 178 to all the nozzles 72 is thus controlled by a single valve 192.

The flow of glue from the nozzle 72 to the blank 82 is accomplished by a combination of pressure and natural frictional forces. Conveniently, a pressure head is created in the adhesive by the height of the manifold 178 above the glue nozzles supplemented if necessary by pressurization. In addition, the adhesive is pulled from the nozzle 72 by the friction between the adhesive and the blank 82. Since the glue nozzle 72 has a curved blank contacting surface 198, it is possible to apply glue when the cantilevered beam 38 is moving in either of its two directions.

After the beam 38 has proceeded from one side of station 22 to the other, a liner 200, shown in dashed lines in FIG. 1, is positioned atop the blank 82 over the recently applied adhesive. Conveyors 32 are then operated to forward the blank 82 into the compression station 24. Movement of the blank 82 is accomplished by grippers 158 that clamp the blank trailing edge 202 between the gripper horizontal portions 160 and the supporting surface 30. The tapered leading edge 203 of portion 160 facilitates the securement of the blank under the portion 160. Thus the blank 82 is slid under overhead framework 94 until the blank is precisely aligned with the framework 94 when the conveyor is stopped.

As a new blank 82 is being positioned at glue applicating station 22, horizontal block 100 is lowered to its downward position compressing the liner 200 against the blank 82 and securing it pemanently thereto. The combined liner and blank is shown in FIG. 9*b*. The liner 200 extends over the length of the blank 82, between longitudinal seams 89 to provide reinforcement of the sides of a box formed from the blank. The liner 200 also has seams 205 positioned directly over seams 88 of blank 82.

The combined liner and blank is then conveyed to the folding station 26 while the following blank with liner attached is forwarded to the compression station 24 as previously described. Conveniently, the adhesive is applied to the following blank 82 by reversing the direction of translation of the cantilevered beam 38 thereby returning it to its original position.

As the blank 82 leaves the compression station 24 for the folding station 26 and exits from under overhead framework 94, glue is automatically applied to flap 204 by glue gun 116 shown in FIGS. 1, 2 and 6. The stationary glue gun 116, identical to glue guns 42 at glue application station 22, applies a transverse glue strip 117 to the flap 204 as shown in FIG. 9*c*. Once the blank 82 is positioned in the folding station 26 the conveyor is again stopped. Still another blank is now placed on glue applicating station 22 with the blank previously at station 22 proceeding to station 24.

Once the blank 82 reaches station 26, positioned beneath swords 114, atop vacuum outlets 118, the vacuum outlets 118 are activated causing the blank 82 to be secured to surface 108. Folding arms 112 are then actuated as shown in FIG. 6 to fold the blank 82 around seams 88*a* and 88*c* as shown in FIGS. 9*c* and 9*e*. This is accomplished by operating one set of folding arms 112 slightly before operating the other set so that the flap 204 with the glue applied is rotated face down atop what was formerly the underside of opposed edge 208 of the blank 82 to form an adhesive joint 210. The position of the blank 82 is also maintained during the folding operation by the imposition of the swords 114 that insure that the blank is folded only around the seams 88.

Once the folding arms 112 are in the position shown in FIG. 6, the rotatable guide sled 136 is rotated around an axis transverse to the direction of blank forwarding atop the folded tubular blank 82 over joint 210 to maintain the connection between the flap 204 and the edge 208. With the sled 136 retaining the recently formed bond, as shown in FIG. 7, the folding arms 112 are returned to their normal lowered position beneath the surface 108 as shown by dashed lines in FIG. 9*f*.

At this time the vacuum applied to vacuum outlets 118 is automatically discontinued and conveyors 32 are again operated to transfer the blank from the folding station 26 to the final compression station 28. As the blank is conveyed, joint 210 slides beneath sled 136 thereby secured against unfolding by the overhead imposition of the sled 136. As the blank is forwarded toward the station 28 the blank slides off the end of swords 114.

The joint 210 is then compressed in final compression station 28 by platen 148. The joint 210 is preserved against opening in station 28 by the end 144 of guide sled 136 still in its downward position. When the platen 148 is pressed against the joint 210 the sled 136 is then returned to its upward position.

The finished blank proceeds to a stacking station (not shown) after release by conveyors 32. The release of the finished blank 82 by grippers 158 is accomplished by the actuation of pin 166 causing rotation of horizontal portion 160 as described previously.

In the embodiment pictured, four blanks can be operated upon at one time. If desired, additional stations 22 through 28 can be interposed between those already shown to enable concurrent operation upon an even higher number of blanks 82. In any case, after the initial positioning of the blank 82 on the glue application station 22, subsequent operations are timed for automatic machine control. Thus an appropriate controlling means such as a computer is used to convey the blank from station to station and to operate the appropriate mechanisms at each station at the appropriate time.

Many modifications and variations of the present invention are possible in light of the above teaching. Thus, it is to be understood that, within the scope of the appended claims, the invention may be practiced otherwise than as specifically described above.

What is claimed and desired to be secured by Letters Patent of the United States is:

1. An apparatus for lining bulk box blanks comprising:
   - a glue application station including a surface for supporting said blanks;
   - means for forwarding said blanks through said apparatus;
   - a plurality of side by side glue applicators;
   - means for automatically applying a plurality of discrete glue strips across said blank and control means for preventing application of glue to the blank fold seams;
   - means for moving said glue applicators across said blank transverse to the direction of forwarding said blank; and
   - means for securing a liner to said blank and for folding said blank to form an open ended tube.

2. The apparatus of claim 1, said glue applicators being mounted on a translatable cantilevered beam positioned above said surface of said glue application station.

3. The apparatus of claim 2 including means for translating said beam across said station and for simultaneously applying an intermittent flow of adhesive from said applicators.

4. The apparatus of claim 3 wherein said glue applicators are adjustably mounted along said beam.

5. The apparatus of claim 3 wherein said glue applicators are mounted for rotation and vertical movement relative to said beam.

6. The apparatus of claim 1 wherein said means for securing said liner to said blank includes a compressor station connected to said glue application station including means for compressing a blank and liner.

7. The apparatus of claim 6 wherein said compression means includes a reciprocating compressor having a resilient surface.

8. The apparatus of claim 7 wherein said resilient surface is covered by an adhesive resistant layer.

9. The apparatus of claim 6 wherein said compression station and said glue application station are separable modules.

10. The apparatus of claim 6 wherein said glue application station includes a translating cantilevered beam, said glue applicators being attached to said beam, said beam being mounted along the edge of said glue application station adjacent said compression station.

11. The apparatus of claim 6 said folding means including a folding station having a support surface, including means for folding together a pair of opposed blank edges.

12. The apparatus of claim 11 said folding means including a pair of opposed folding arms, rotatable around axis parallel to said direction of forwarding.

13. The apparatus of claim 12 including a vacuum suction retaining mechanism arranged to hold said blank while said blank is being folded by said folding means.

14. The apparatus of claim 12 including a folding sword mounted above the surface of said folding station extending parallel to said surface in the direction of forwarding, along the fold line of said folding means.

15. The apparatus of claim 11 including means for applying glue along an edge of said blank as said blank is forwarded from said compression station to said folding station.

16. The apparatus of claim 11 including means for retaining said blanks in a folded configuration.

17. The apparatus of claim 16 said retaining means including a rotatable sled mounted to rotate atop said folded blank to a position spaced sufficiently above said surface to permit said folded blank to be conveyed relative to said sled.

18. The apparatus of claim 17 including a final compression station including means for compressing said blank, said sled retaining said blank in its folded configuration between said folding station and said compression station.

19. The apparatus of claim 18 wherein said final compression station and said folding station are separable modules.

20. The apparatus of claim 1 said conveying means including a continuous strand having outwardly extending grippers to retain said blanks.

21. The apparatus of claim 20 wherein said grippers are L-shaped.

22. The apparatus of claim 21 wherein said grippers are rotatable from a gripping position to a retracted position.

23. The apparatus of claim 21 wherein said grippers are cam actuated.

24. A method for lining bulk box blanks comprising the steps of:

positioning a bulk box blank at a glue application station;

translating a glue assembly across said blank in a first direction;

applying glue to selected regions of said blank as said glue applicating assembly is translated across said blank;

positioning a liner atop said blank;

forwarding said blank to a compression station in a direction generally transverse to said first direction;

compressing said liner to said blank;

applying a glue strip near one edge of said blank and folding said edge atop another edge of said blank to form a tubular blank; and compressing said edges of said blank together to form a joint.

25. The method of claim 24 including the steps of folding said blank at a first location, after compressing said liner against said blank, conveying said blank to a different location for final compression, and retaining said blank in its folded configuration while conveying said blank between said locations.

26. The method of claim 25 said retaining step including the steps of rotating a sled atop the folded blank and sliding said blank beneath said sled.

27. The method of claim 24 including the step of discontinuing the application of glue while said glue applicating assembly is translated across a blank seam.

28. The method of claim 24 wherein said blank is forwarded intermittently.

29. The method of claim 24 wherein said folding step concludes the steps of folding two opposed edges of said blank together by a pair of folds around spaced fold lines.

30. The method of claim 24 including the steps of securing said blank to a conveyor at a glue application station and releasing said blank from said conveyor after the step of forming said joint.

* * * * *